United States Patent [19]

Hallenius et al.

[11] 3,996,751

[45] Dec. 14, 1976

[54] METHOD OF BLASTING AND REINFORCING ROCK CAVITIES

[76] Inventors: Tore Jerker Hallenius, Esplanaden 23, 852 32 Sundsvall; Karl Ivar Sagefors, Svetsarvagen 5, 175 73 Jarfalla, both of Sweden

[22] Filed: May 29, 1974

[21] Appl. No.: 474,221

[30] Foreign Application Priority Data

July 30, 1973 Sweden ..... 7310504
May 16, 1974 Sweden ..... 7406572

[52] U.S. Cl. ..... 61/42; 61/.5
[51] Int. Cl.[2] ..... E01G 1/00; E21D 11/00
[58] Field of Search ..... 61/42, 84, .5, 41 R, 61/45 R; 299/11

[56] References Cited

UNITED STATES PATENTS

| | | | |
|---|---|---|---|
| 960,940 | 6/1910 | Jackson | 61/42 |

FOREIGN PATENTS OR APPLICATIONS

| | | | |
|---|---|---|---|
| 728,858 | 7/1932 | France | 61/42 |
| 1,058,535 | 6/1959 | Germany | 61/84 |
| 1,809,326 | 6/1970 | Germany | 61/42 |

*Primary Examiner*—Paul R. Gilliam
*Assistant Examiner*—David H. Corbin
*Attorney, Agent, or Firm*—Strauch, Nolan, Neale, Nies & Kurz

[57] ABSTRACT

Before the rock cavity is completely excavated a plurality of arcuated tunnels extending between the top and bottom levels of the intended rock cavity are cut out in the rock outside the future side walls of the cavity, and these tunnels are filled with reinforcing material, preferably concrete, so as to form a rib-like reinforcement structure which is wholly embedded in the rock surrounding the rock cavity.

9 Claims, 8 Drawing Figures

METHOD OF BLASTING AND REINFORCING ROCK CAVITIES

The invention relates to a method of blasting and reinforcing rock cavities.

Any blasting of a cavity in rock causes a change of the state of equilibrium of the mass of the rock, and forces will arise which strive to produce a new state of equilibrium. These forces may cause crack formation and fractures in the walls, bottom and roof of the rock cavity. The effect of these forces become greater the poorer the quality of the rock is and the larger the dimensions of the rock cavity are. These circumstances set an upper limit of the dimensions of the rock cavity.

It has been common practice for a long time to reinforce rock cavities by wholly or in part lining the insides of the cavity with concrete and binding the concrete lining to the rock by bolting. Through these reinforcement measures the rock cavity can be given considerably larger dimensions than would otherwise be possible. However, even though these reinforcement measures are adopted it is not possible to cut out rock cavities having a larger width than 25 – 30 m (82 – 97 feet) in rock of fairly good quality.

Recently a need for rock cavities having still larger dimensions has arisen. Thus, for many reasons it would be advantageous to locate nuclear power plants in rock cavities. However, for this purpose rock cavities are required having considerably larger dimensions than those which can be produced by conventional methods.

It is an object of the present invention to provide a method of blasting and reinforcing rock cavities permitting the construction of rock cavities having considerably larger spans than those which could be produced by prior methods.

The method according to the invention is characterized by the following steps: Before a rock cavity is completely excavated a plurality of arcuated tunnels extending between the bottom and top levels of the future side walls of the rock cavity are cut out in the rock outside the future side walls of the rock cavity, and these arcuated tunnels are filled with a reinforcing material to form in said tunnels arcuated beams of reinforcing material which are wholly embedded in the rock outside the rock cavity. The reinforcing material used to fill the said arcuated tunnels is preferably reinforced concrete, but other materials, for instance steel, having the same strength properties may be used for this purpose.

The method according to the invention provides a rib-like structure of the reinforcing material, concrete, steel or the like, which is entirely enclosed in the rock and forms with the surrounding rock a structure having an extremely high compressive strength. By a proper choice of the dimensions and the spacing of the "ribs" it is possible to produce rock cavities having exceptionally large spans even in rock of poor quality.

In a preferred embodiment of the invention tunnels are cut out in the rock above the roof of the rock cavity and underneath the bottom of the rock cavity, each such tunnel joining the ends of two arcuated tunnels located outside opposite side walls of the rock cavity. The tunnels above the roof of the rock cavity and underneath the bottom of the rock cavity are also filled with reinforcing material, thereby forming together with the reinforcing material in said arcuated tunnels outside the side walls closed loops of reinforcing material encircling vertical sections of the rock cavity.

The work of cutting out the rock cavity can be carried on simultaneously with the reinforcement works. However, the reinforcement structure should be completed before the side walls of the rock cavity are wholly exposed.

The costs of the reinforcement are relatively small as counted per cubic meter of rock.

The invention will be described more in particular with reference to the accompanying drawings.

DESCRIPTION OF THE PREFERRED EMBODIMENTS

Figure 1:
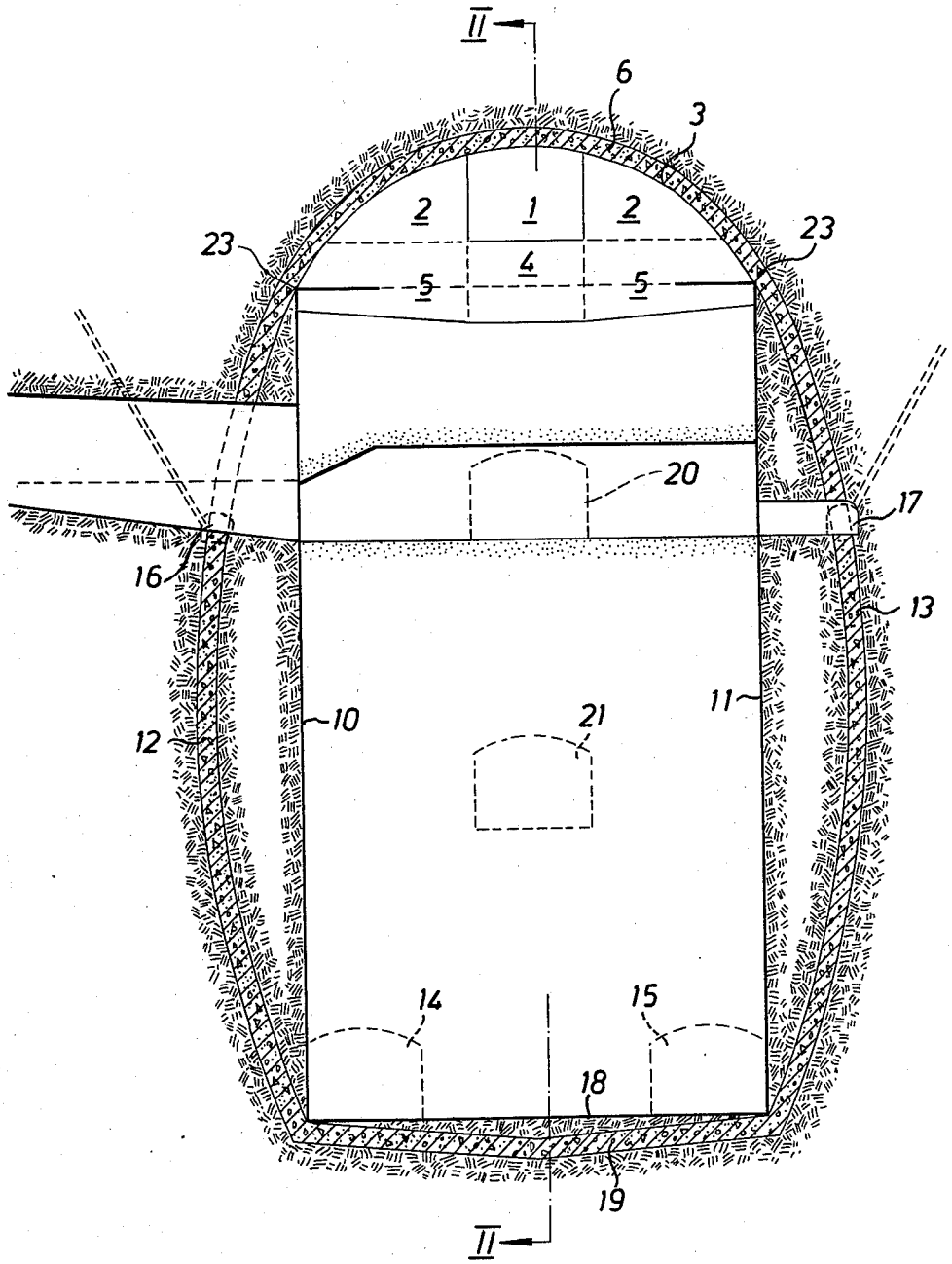
FIG. 1 shows a cross-section of a rock cavity produced by the method according to the invention.
Figure 2:
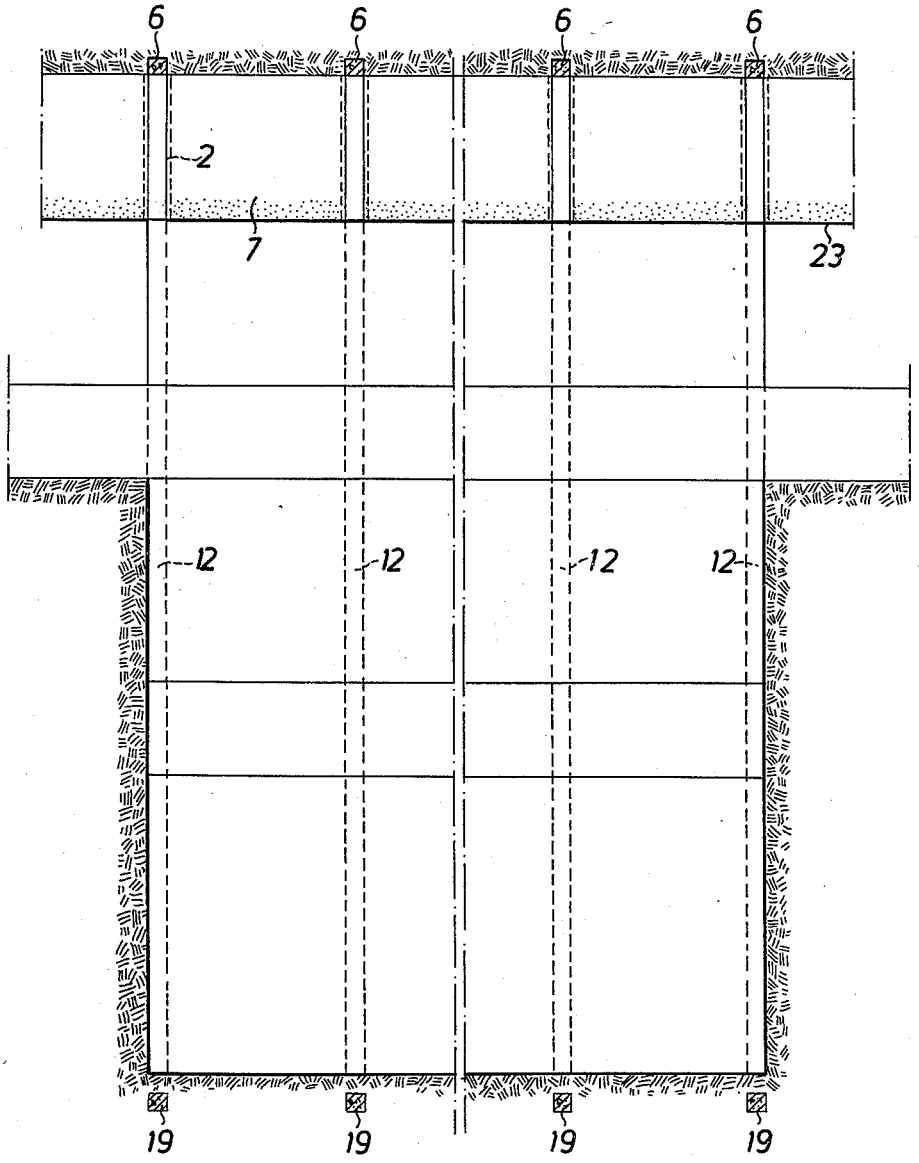
FIG. 2 shows a section along line II–II in FIG. 1.

Referring now to FIGS. 1 and 2 the rock cavity shown in these figures is assumed to have a rectangular horizontal section and an arched roof.

The side walls of the rock cavity are designated 10 and 11. According to the invention arcuated tunnels 12 and 13 which extend from the bottom level of the rock cavity to the roof abutment are driven in the rock outside the intended side walls before these have been wholly exposed. These tunnels are preferably driven from below and upwards. At the bottom of the rock cavity two working tunnels 14 and 15 have been indicated by dash lines and the driving of the said arcuate tunnels 12 and 13 can be commenced from these working tunnels. Further working tunnels may be provided at different levels and parallel to the side walls 10 and 11 in order to speed up the driving of the tunnels 12 and 13, and in FIG. 1 two additional working tunnels 16 and 17 are shown.

The tunnels 12 outside one side wall 10 are located opposite the tunnels 13 outside the other side wall 11. The pairs of opposite tunnels 12 and 13 thus formed are located with equal spacing. This spacing and the dimensions of the tunnels should be determined under consideration of the nature of the rock and the size of the rock cavity.

In the arched roof of the rock cavity slots 6 are cut out which have substantially the same cross-section as the tunnels 12 and 13. Each slot 6 is so positioned that its ends meet the upper ends of a pair of tunnels 12 and 13 at the abutment 23. The transition between the tunnels 12 and 13 and the slot 6 is preferably made continuous so that the said tunnels and slot together form a horseshoe-shaped curve.

In the rock underneath the future bottom 18 of the rock cavity tunnels 19 are driven each of which extends between the bottom ends of a pair of arcuated tunnels 12 and 13. The tunnels 19 are slightly sloped downwards in relation to the horizontal plane.

The arcuated tunnels 12 and 13, the slots 6 and the tunnels 19 are filled with a reinforcing material which in the shown embodiment is assumed to be concrete and preferably reinforced concrete. The beams of concrete formed in the tunnels 12 and 13 should extend without interruption along the whole length of the tunnels through working tunnels 16 and 17 which may be provided, and therefore a formwork is required in these working tunnels.

The blasting and enlargment of the rock cavity can be carried on simultaneously with the forming of the reinforcement structure. In FIG. 1 the location of a pair of working drifts 20 and 21 for the enlargement is shown by dash lines. However, this enlargement must not be carried on up to the intended walls 10 and 11 before the reinforcement structure has been completed.

For blasting the roof arch the longitudinal tunnel 1 may first be cut out along the whole length of the rock cavity. From this tunnel 1 slots 2 are cut out towards both sides to meet the arcuated tunnels 12 and 13, and at the same time the slots 6 in the roof are blasted. Then anchoring drilling and formwork 3 for the concrete arcs at the top portion of the arch is performed. Then a bench 4 is blasted and the said slots are made deeper at 5. The concrete arcs can now be cast into the slots 6. After the hardening of the concrete the protruding rock 7 between the slots can be blasted away.

After the reinforcement structure has been completed and the rock cavity has been wholly blasted the side walls 10 and 11 can be reinforced in known manner by means of a concrete lining. This concrete lining can be connected to the concrete beams in the tunnels 12 and 13 by bolting, e.g., by means of pre-stressed bolts.

Instead of being reinforced by means of concrete arcs placed in slots, the roof may be provided with an integral lining of concrete.

Figure 3:
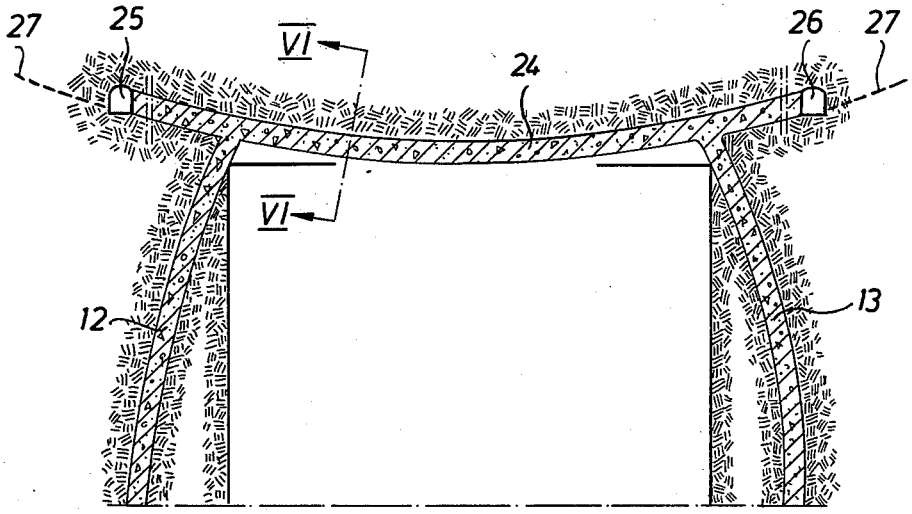
FIG. 3 shows a cross-section of a rock cavity produced by the method according to the invention having a roof structure different from that shown in FIG. 1.
Figure 3:
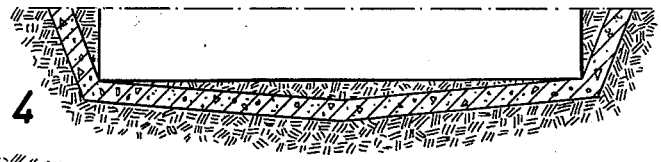
Figure 4:
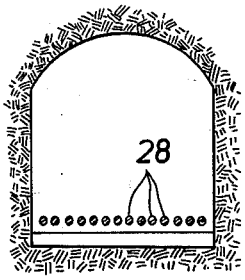
FIG. 4 shows on a larger scale a section along line VI—VI in FIG. 3.

FIG. 3 shows a rock cavity produced by the method according to the invention but having a roof reinforcement different from that shown in FIG. 1. In the rock above the intended roof of the rock cavity tunnels 24 are cut out which are slightly curved downwards in relation to the horizontal. Each such tunnel 24 touches the upper ends of a pair of arcuated tunnels 12 and 13 and extend outside the ends of these tunnels. The tunnels 24 are driven from working drifts 25 and 26. The tunnels 24 are filled with concrete. Since the concrete beam so formed is subjected to a tensile stress it is provided with a pre-stressed reinforcement 28 which is shown in FIG. 4. The dash lines 27 indicate drilling holes for anchoring the reinforcement rods 28. The location of the working drifts 25 and 26 is determined under consideration of the quality of the rock, the desired span and the number of reinforcement rods for absorbing the pre-stressing forces.

Figure 5:
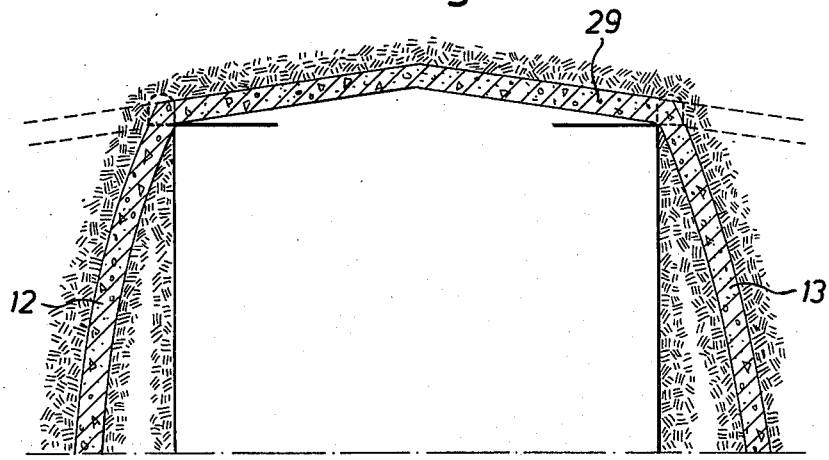
FIG. 5 shows a cross-section of a rock cavity produced by the method according to the invention with another modification of the roof reinforcement.

The roof reinforcement shown in FIG. 5 differs from that shown in FIG. 3 by the tunnels 29 above the roof being curved upwards in relation to the horizontal. The tunnels 29 are also filled with concrete, and the concrete beams so formed are subjected to compressive forces and therefore the reinforcement does not need to be pre-stressed in this case.

Figure 6:
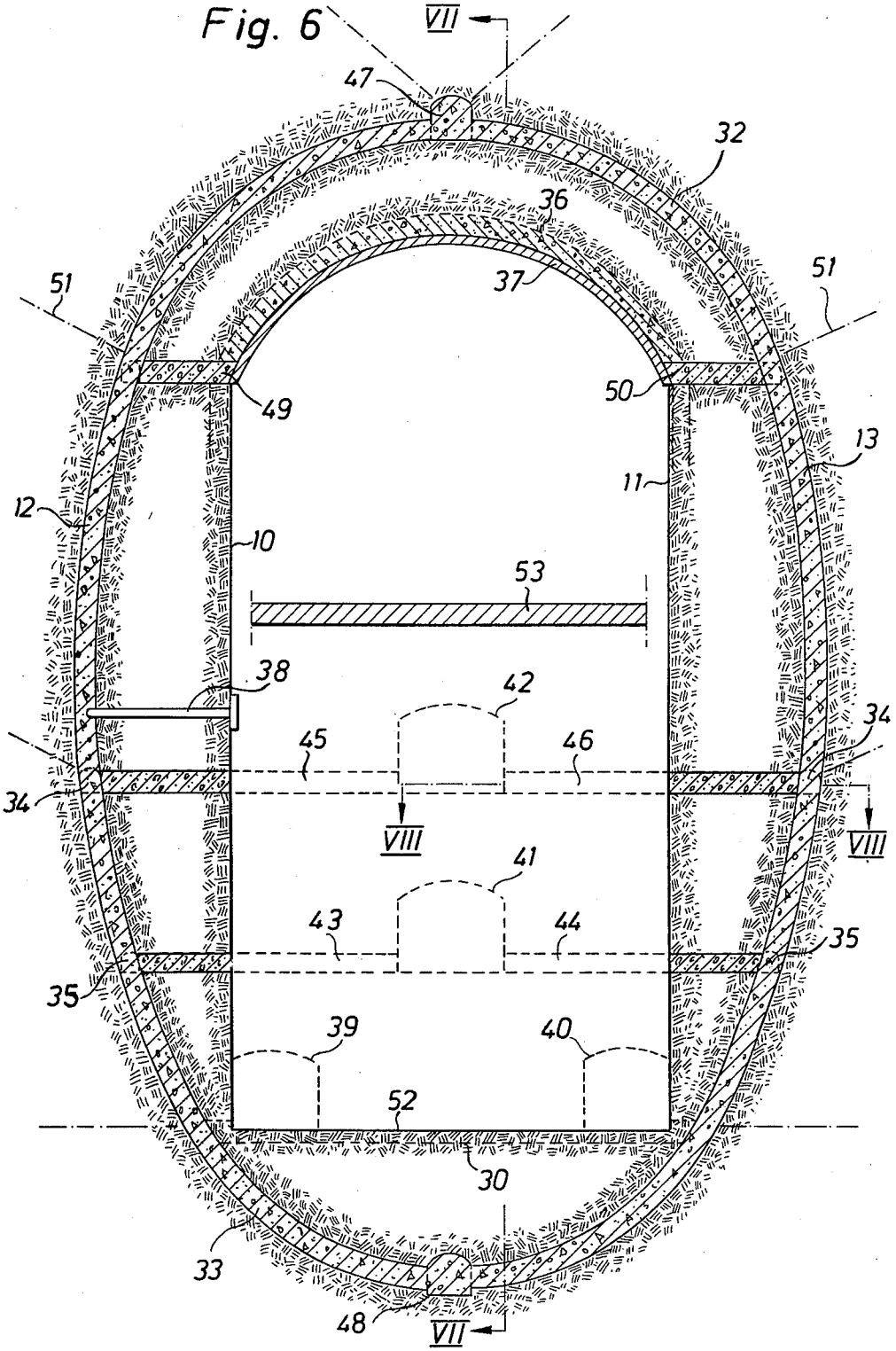
FIG. 6 shows a cross-section of a rock cavity produced by another embodiment of the method according to the invention.
Figure 7:
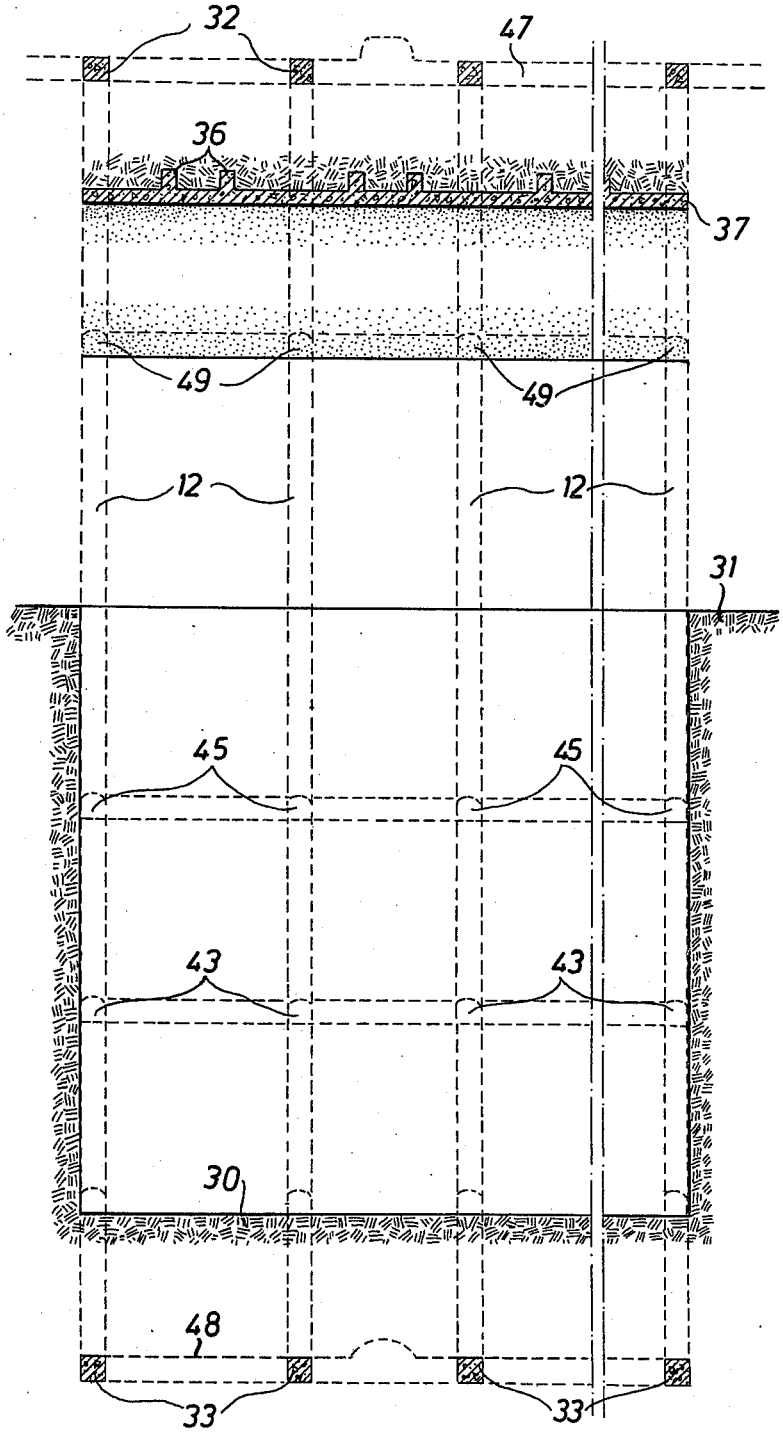
FIG. 7 shows a partial section taken along line VII—VII in FIG. 6.
Figure 8:
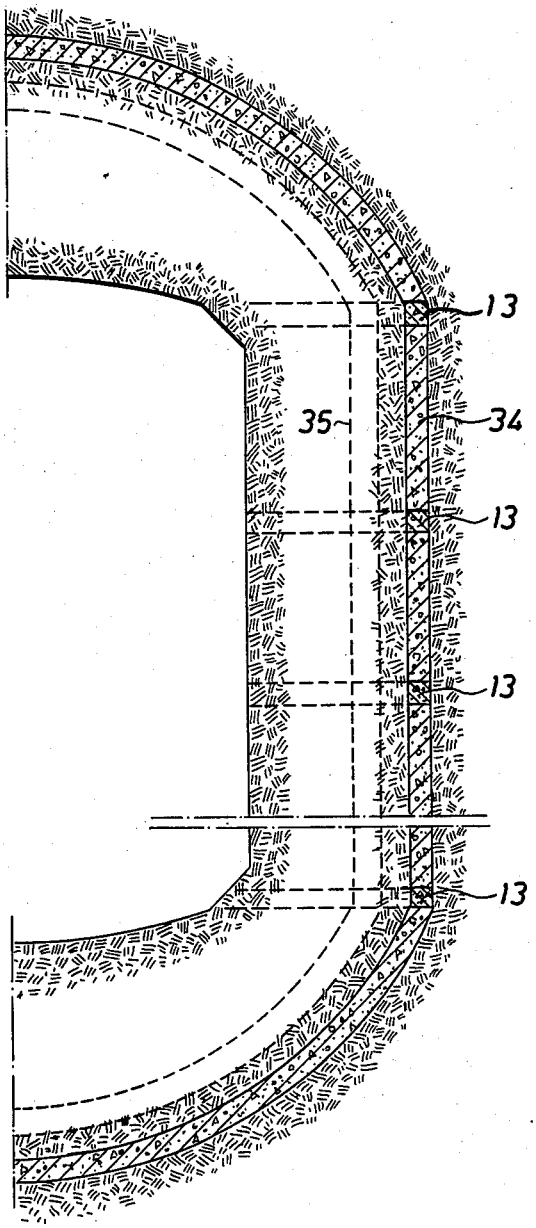
FIG. 8 shows a partial section taken along line VIII—VIII in FIG. 6.

FIGS. 6 to 8 show a rock cavity intended to accommodate a nuclear power plant. The rock cavity has an oblong, substantially rectangular form and an arched roof. The rock cavity has two different bottom levels indicated 30 and 31. Thus, the rock cavity has a deeper portion with the bottom 30. This deeper portion is intended to accommodate the nuclear reactor. The other parts of the nuclear power plant, such as turbines, generators and other equipment, would be acccommodated in those portions of the rock cavity having the upper bottom level 31.

In the rock outside the side walls 10 and 11 of the rock cavity there are cut out arcuated tunnels 12 and 13 which extend from the level of the lower bottom 30 up to the level of the roof abutment. The top ends of the tunnels 12 and 13 are located within the rock at a certain distance from the roof abutment. The tunnels 12 outside one side wall 10 are located opposite separate ones of the tunnels 13 outside the opposite side wall 11. The top ends of the two tunnels 12 and 13 of each such pair of opposite tunnels are connected to each other by means of a curved tunnel 32 cut out in the rock above the roof of the rock cavity. The bottom ends of the two tunnels 12 and 13 of each such pair of opposite tunnels are also connected to each other by means of a tunnel 33 cut out in the rock underneath the bottom 30 of the rock cavity. The tunnels 32 and 33 are also arcuated and form a continuous extension of the tunnels 12 and 13, so that the tunnels 12, 32, 13 and 33 form a single continuous tunnel extending in a vertical plane around the whole cross-section of the rock cavity. These tunnels are filled with reinforcing material, preferably reinforced concrete, thereby forming in the rock outside the rock cavity a number of vertically extending loops of reinforcing material encircling the rock cavity. Each such loop has an oval or approximately elliptical form as shown in FIG. 6.

In the rock outside the rock cavity there are also cut out horizontal tunnels encircling the rock cavity. In the embodiment shown in FIGS. 6–8 there are two such horizontal tunnels 34 and 35 located at different levels and encircling the deeper portion of the rock cavity. These horizontal tunnels 34 and 35 cross the tunnels 12 and 13 and are also filled with reinforcing material, preferably reinforced concrete. Hereby the rock mass surrounding the rock cavity is reinforced with a cage-like or basket-like structure of reinforcing material. A reinforcement structure of this form affords an extremely high resistance against forces appearing in the rock mass which strive to cause cracks, fractures and deformation of the rock surrounding the rock cavity.

The arched roof of the rock cavity may be provided with slots 36 which are filled with concrete. Also the whole roof can be provided with an internal lining 37 of concrete. The arcs of concrete formed in the slots 36 preferably rest by their ends (at the roof abutment) on vertical columns of concrete provided along the side walls of the rock cavity. The walls 10 and 11 of the rock cavity may also be completely lined in known manner with a concrete lining. This concrete lining can be connected by bolting with the beams of reinforcing material in the tunnels 12 and 13. In FIG. 6 such bolting has been indicated by a single bolt 38. The number of bolts connecting a side wall with the beams of reinforcing materials in the tunnels 12 or 13 is of course chosen under consideration of the quality of the rock and the desired strength. Such bolting means a pressurized reinforcement of the rock between the reinforcing beams in the tunnels 12 and 13 and the walls of the rock cavity, whereby a considerably increased strength and safeguarding against deformations of the rock surrounding the rock cavity is achieved.

The procedure in blasting and reinforcing a rock cavity as shown in FIGS. 6–8 is broadly as follows.

At first access tunnels are driven into the rock. In FIG. 6 some access tunnels 39, 40, 41 and 42 are indicated by dash lines. These access tunnels extend in the longitudinal direction of the rock cavity to be excavated. From these access tunnels working tunnels or drifts are driven towards the intended side walls of the rock cavity, and these working tunnels are extended into the rock outside the future walls to places through which the tunnels 12, 13 and the tunnels 34, 35 are to pass. In FIG. 6 some such working tunnels 43–46 are indicated by dash lines. The working tunnel 43 is driven from the access tunnel 41 into the rock to a place where the tunnels 12 and 34 are to cross each other, and the working tunnels 44–46 are driven correspondingly into the rock to other places in the rock where tunnels 12, 13 are to cross tunnels 34, 35. The tunnels 34, 35 and 12, 13 are then driven starting from the ends of the working tunnels 43–46. Thus, the driving of the tunnels 34, 35 and 12, 13 can be started and carried on simultaneously from different starting points. The curved tunnels 32 above the future roof of the rock cavity and the curved tunnels 33 underneath the future bottom of the rock cavity are driven from working tunnels 47 and 48 respectively. Horizontal working tunnels 49 and 50 are also driven from an access tunnel (not shown) adjacent the roof of the rock cavity towards the places in the rock where the ends of the tunnel 32 are to meet the ends of tunnels 12 and 13. The driving of the tunnel 32 may also be carried out starting from the ends of the working tunnels 49 and 50.

At certain points in the system of tunnels drainage holes are drilled into the rock for leading away water that may be present in interstices in the rock. In FIG. 6 some such drainage holes are indicated by dash-dot lines and designated 51. These drainage holes are connected to a tube system (not shown) which is placed in the system of tunnels 12, 13, 34, 35 before these tunnels are filled with the reinforcing material. This tube system should preferably terminate at the lowest portion of the reinforcement structure, that is at the working tunnel 48, and is there connected to a suitable pumping machinery.

The excavation of the rock cavity can be commenced and carried on simultaneously with the driving of said tunnels in the rock outside the rock cavity. However, the last-mentioned tunnels should be completed and filled with reinforcing material and this reinforcing material, if it is concrete, should be caused to harden before the walls, roof and bottom of the rock cavity are completely exposed. Thus, the reinforcement structure forms a pre-reinforcement of the rock before the rock cavity is completely excavated. Those, parts of the working tunnels 43–45, 49 and 50 which remain in the rock after the side walls of the rock cavity has been completely exposed are also filled with reinforcing material. The working tunnels 47 and 48 at the top and bottom portions respectively of the reinforcement structure are also filled with reinforcing material.

The two bottoms 30 and 31 of the rock cavity may be reinforced with beams of concrete 52 and 53 respectively.

In the shown embodiments the tunnels (12, 13, 34, 35) cut out in the rock outside the rock cavity have a substantially square cross-section. However, the cross-section of these tunnels may also have other forms, for instance a rectangular form. If these tunnels have a rectangular cross-section, this cross-section should be so oriented that it has its least extension in a direction parallel to the walls of the rock cavity. Hereby the beams of reinforcing material formed in these tunnels will afford the greatest resistance against the forces acting upon the reinforcement structure.

The various working operations in excavating the rock cavity and the tunnels outside it, such as drilling, loading, blasting, scaling and removal of rock spoil, can be carried out by methods well known in the art and will not be described in particular. The driving of the vertical arcuated tunnels 12 and 13 can be carried out with advantage by means of raise climbers of the type ALIMAK (registered trade mark).

What we claim is:

1. A method of forming a reinforced rock cavity comprising the steps of: predetermining the location of a future rock cavity of preplanned length, width and depth dimensions and having top, bottom and opposite side walls; driving access tunnel means to the vicinity of said planned reinforced rock cavity, cutting out in the rock outside of and spaced longitudinally from at least the preplanned side walls and bottom wall a plurality of arcuated tunnels from said access tunnel means; filling said arcuated tunnels with a reinforcing material; forming top wall reinforcing means which includes a reinforcing material and which extends between upper ends of the arcuated tunnels outside of the side walls and bottom walls whereby, in vertical cross-section, the arcuated tunnels and top wall reinforcing means lying in the same vertical plane form a completely closed continuous loop which entirely encircles and reinforces the preplanned rock cavity; and excavating rock disposed within the planned outline of the rock cavity; said steps of cutting out said arcuated tunnels, filling them with reinforcing material and forming said top wall reinforcing means being carried out before the rock cavity is completely excavated up to the side walls of the rock cavity, at least said side walls and bottom walls being spaced from and so disposed with respect to said arcuated tunnels that a substantial mass of undisturbed material remains between said arcuated tunnels and said side walls and bottom wall after said rock cavity is completely excavated and formed.

2. The method as claimed in claim 1 in which the said step of filling said arcuated tunnels with a reinforcing material comprises filling said arcuated tunnels with concrete.

3. The method as claimed in claim 1, wherein said step of forming the top wall reinforcing means includes excavating rock at the said preplanned top wall to form an arched roof extending across to the upper ends of the arcuated tunnels formed outside of the side walls.

4. A method as claimed in claim 1, in which said step of forming top wall reinforcing means comprises the further steps of: cutting out transverse tunnels in the rock above the future roof of the rock cavity and extending each such transverse tunnel to touch the top ends of two of said arcuated tunnels located outside opposite side walls of the rock cavity, filling said tunnels above the roof with reinforcing material to form beams of said reinforcing material, each such beam being connected to the beams of reinforcing material formed in two of said arcuated tunnels located outside opposite walls of the rock cavity.

5. The method as claimed in claim 1 wherein said step of forming the top wall reinforcing means includes excavating rock at the said preplanned top wall to form a roof curved downwardly and inwardly towards said bottom wall and extending across to the upper ends of the arcuated tunnels formed outside of the side walls.

6. The method as claimed in claim 1 wherein said step of forming the top wall reinforcing means includes excavating rock at the said preplanned top wall to form a roof having upwardly sloping sides joined at a peak above said bottom wall and extending across the upper ends of the arcuated tunnels formed outside of the side walls.

7. The method as claimed in claim 1 comprising the further steps of providing the walls of the rock cavity after excavation with a lining of concrete and anchoring said lining by bolt means connecting the lining with the loops of reinforcing material.

8. A method of forming a reinforced rock cavity comprising the steps of: predetermining the location of a future rock cavity of preplanned length, width and depth dimensions and having top, bottom and opposite side walls; driving access tunnel means to the vicinity of said planned reinforced rock cavity; cutting out in the rock outside of and spaced longitudinally from said preplanned top wall, side walls and bottom wall a plurality of arcuated tunnels from said access tunnel means each such arcuated tunnel being formed as a closed, complete ring of substantially oval shape encircling a vertical section of the preplanned rock cavity; filling said arcuated tunnels with a reinforcing material to thus form, in vertical cross-section, a plurality of arcuated tunnels each forming a completely closed continuous loop which entirely encircles and reinforces the preplanned rock cavity; and excavating rock disposed within the planned outline of the rock cavity; said steps of cutting out said arcuated tunnels and filling them with reinforcing material being carried out before the rock cavity is completely excavated, said top wall, side walls and bottom walls being spaced from and so disposed with respect to said arcuated tunnels that a substantial mass of undisturbed material remains between said arcuated tunnels and said top wall, side walls and bottom wall after said rock cavity is completely excavated and formed.

9. A method of forming a reinforced rock cavity comprising the steps of: predetermining the location of a future rock cavity of preplanned length, width and depth dimensions and having top, bottom and opposite side walls; driving access tunnel means to the vicinity of said planned reinforced rock cavity; cutting out in the rock outside of and spaced longitudinally from the top wall, side walls and bottom wall a plurality of first and second arcuated tunnels from said access tunnel means; each of said first tunnels running outside the future bottom, roof and two opposite side walls of the rock cavity thereby forming a closed path of substantially oval shape encircling a vertical section of the rock cavity, and each of said second tunnels running substantially horizontally in a closed path encircling a horizontal section of the rock cavity with said second tunnels intersecting said first tunnels, and filling said first and second tunnels with reinforcing material to form a cage-like structure of said reinforcing material embedded in the rock surrounding the rock cavity, said top wall, side walls and bottom walls being spaced from and so disposed with respect to said arcuated tunnels that a substantial mass of undisturbed material remains between said arcuated tunnels and said top wall, side walls and bottom wall after said rock cavity is completely excavated and formed.

* * * * *